US007006408B2

(12) United States Patent
Chen

(10) Patent No.: US 7,006,408 B2
(45) Date of Patent: Feb. 28, 2006

(54) WRISTWATCH CAPABLE OF STORING AND TRANSMITTING DATA

(75) Inventor: Leo Chen, Hong Kong (CN)

(73) Assignee: Zhuhai Xonix Electronic Watch Company Limited, Zhuhai (CN)

( * ) Notice: Subject to any disclaimer, the term of this patent is extended or adjusted under 35 U.S.C. 154(b) by 38 days.

(21) Appl. No.: 10/687,392

(22) Filed: Oct. 15, 2003

(65) Prior Publication Data

US 2004/0081025 A1 Apr. 29, 2004

(30) Foreign Application Priority Data

Oct. 18, 2002 (CN) ..... 02248824 U
Dec. 17, 2002 (CN) ..... 02293251 U
Jun. 10, 2003 (CN) ..... 03247092 U

(51) Int. Cl.
*B41J 29/38* (2006.01)

(52) U.S. Cl. ..... 368/10; 368/281

(58) Field of Classification Search ..... 368/10, 368/278, 281, 282, 289, 291
See application file for complete search history.

(56) References Cited

U.S. PATENT DOCUMENTS 5,615,179 A * 3/1997 Yamamoto et al. ..... 368/281
5,894,454 A * 4/1999 Kondo ..... 368/11
6,192,253 B1 * 2/2001 Charlier et al. ..... 455/575.7
6,536,941 B1 * 3/2003 Fang ..... 368/281
6,753,882 B1 * 6/2004 Nakazawa et al. ..... 715/708
2001/0004397 A1 * 6/2001 Kita et al. ..... 381/334
2003/0103413 A1 * 6/2003 Jacobi et al. ..... 368/10
2004/0022130 A1 * 2/2004 Chung ..... 368/10
2004/0151071 A1 * 8/2004 Kocher ..... 368/10

* cited by examiner

*Primary Examiner*—Andrew H. Hirshfeld
*Assistant Examiner*—Leo T. Hinze
(74) *Attorney, Agent, or Firm*—Charles E. Baxley

(57) ABSTRACT

This invention discloses a wristwatch capable of storing and transmitting data of computers. The wristwatch of this invention comprises a timing indicating component, a watch case, and a watch band for fixing the wristwatch to people's wrist, wherein, said wristwatch further comprises a circuit board assembly and a USB connector assembly. The internal structure of the watch case of the wristwatch of the present invention is well sealed, so that the electricity property of the internal elements can be ensured, and the elements for storing and transmitting data of computers can be secured and protected, while the appearance of the wristwatch remains concise and natural.

13 Claims, 15 Drawing Sheets

WRISTWATCH CAPABLE OF STORING AND TRANSMITTING DATA

TECHNICAL FIELD

This invention relates to a wristwatch, and in particular, to a wristwatch capable of storing and transmitting data of computers.

BACKGROUND OF THE INVENTION

A wristwatch, as a timing instrument, is always an indispensable commodity for people in their daily work and life. A wristwatch usually comprises: a time indicating component which is the kernel component of the wristwatch and is used for indicating time; a watch case for housing and protecting the time indicating component; a watch band for fixing the wristwatch to people's wrist and for adorning purpose. With the development of science and technology, people integrate other devices into the wristwatch to make full use of the wristwatch as a portable commodity. For example, in a patent application numbered "CN01 104642.2" and titled "a telephone wristwatch with a SIM card", a wristwatch combined with communication technology is disclosed. But, there is still no portable wristwatch combined with computer technology up to now, despite of the wide spreading and continuous development of computer technology. On the other hand, to meet the desires of data exchange, various types of mobile memory devices are present in the market, such as mobile hard disks, portable memory devices with a USB connectors, etc. Data exchange can be realized between computers by utilizing these products. For example, data from one computer is downloaded and stored to a portable memory device with a USB connector quickly, and then the data in the memory device is transmitted to another computer through the USB connector. Generally, the data stored in these products with Flash Memory can be downloaded rapidly and stored for a long time, for some instance, more than ten years. However, the mobile hard disk is not portable, and the existing portable memory device with a USB connector has to be equipped with a long cable, which connects with the USB connector of the product on its one end, and with the USB port of the computer on the other end. It often causes a lot of inconvenience since a consumer has to always carry the cable with him, and data transmission and storage becomes impossible if the cable is lost. Therefore, it is desirable to develop a portable memory device integrated with daily commodity like a wristwatch, so that the USB product needs not to be carried additionally.

SUMMARY OF THE INVENTION

The main object of the present invention is to provide a portable wristwatch which can store and transmit data rapidly. The internal structure of the watch case of the wristwatch of the present invention is well sealed, so that the electricity property of the internal elements can be ensured, and the elements for storing and transmitting data of computers can be secured and protected, while the appearance of the wristwatch remains concise and natural.

The above object of the present invention is achieved by the following technical scheme. A wristwatch according to the present invention comprises a timing indicating component, a watch case, and a watch band for fixing the wristwatch to people's wrist, wherein, said wristwatch further comprises a circuit board assembly and a USB connector assembly. Said circuit board assembly is installed inside the watch case and comprises a circuit board, on which are installed a Flash Memory and a CPU; said USB connector assembly comprises connection cable and a USB connector, said connection cable consists of data leads and power leads, which are used to connect the circuit board with the USB connector; the USB connector is located outside the watch case, said connection cable extends out of the watch case from an opening hole at the seam between the watch case and the watch band, a water proof means is provided around the opening hole; a housing means for housing and fixing the connection cable and the USB connector is provided on said watch band.

The advantages of the present invention are as follows: since a Flash Memory device is integrated in the wristwatch, the wristwatch can be used to exchange, transmit and store data of computers rapidly at any time and any place, in addition to indicating time. Since the CPU and the Flash Memory are both installed inside the watch case, the volume and weight of the present invention is similar to those of the traditional one, so that, the wristwatch of the present invention is still convenient for carrying and using. Further more, since the housing and fixing means for the USB connector is installed on the watch band, the connection cable and the USB connector are not exposed outside, so that consumers will not feel any inconvenience when the wristwatch are carried and worm. Thus, consumers may possess a wristwatch capable of transmitting and storing data of computers, without carrying a memory device or a mobile hard disk additionally.

As a timing product, the wristwatch is popular, and particularly, when it has some new functions. Hence, a wristwatch capable of storing and transmitting data must be a brand new option for consumers in the domestic and foreign markets, and it will provide utmost convenience for information exchange and communication in the modem society.

DETAILED DESCRIPTION OF THE PREFERRED EMBODIMENTS

The present invention will now be described in details by way of examples with reference to the accompanying drawings.

Embodiment I

Figure 1A:
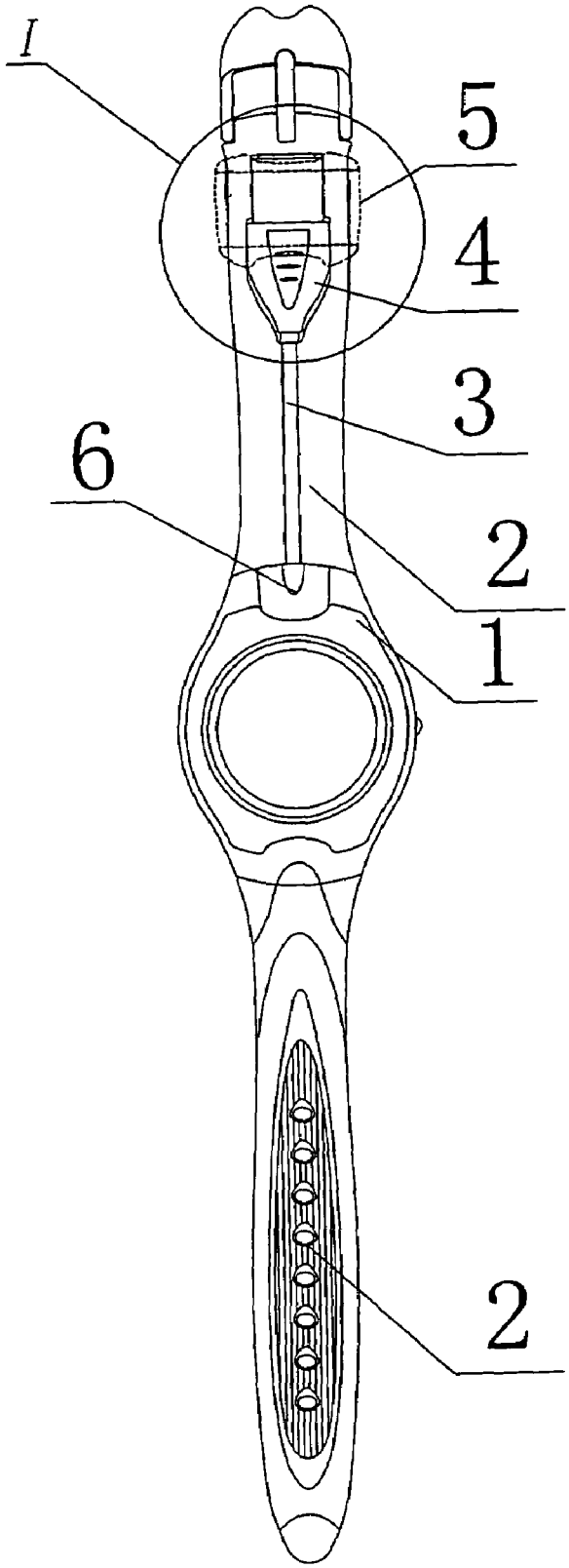
FIG. 1*a* is an overall schematic view of a wristwatch capable of storing and transmitting data according to embodiment I of the present invention.
Figure 1B:
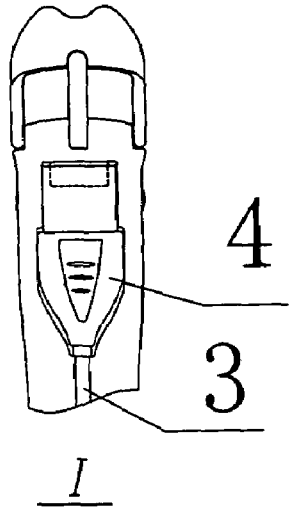
FIG. 1*b* is a schematic view of part I of the wristwatch shown in FIG. 1*a;*

As shown in FIG. 1*a* and FIG. 1*b*, the wristwatch according to the present invention comprises: a time indicating component for indicating time; a watch case 1 for housing and protecting the internal structure of the wristwatch; a watch band 2 for fixing the wristwatch to people's wrist and for adorning purpose; said wristwatch further comprises a Flash Memory and a CPU for storing and transmitting data. Said watch band 2 can be made of various materials, preferably plastics.

As shown in FIGS. 1*a*, 1*b*, 2 and 3, inside the watch case 1 are installed a time indicating component and a circuit board assembly. The time indicating component includes a time movement 9, hands 91, and a time dial, etc. Said time movement 9 is located behind the hands 91 and the time dial; said circuit board assembly includes a circuit board (PCB) 10, a flash memory 101, and a CPU 102. Said circuit board 10 is located between the time movement 9 and the case back 11. Said case back 11 is located on the rearmost position, touching with people's wrist, and making an airtight effect for the wristwatch.

The USB connector assembly comprises connection cable 3 and USB connector 4. Said connection cable 3 are used to connect the circuit board 10 with the USB connector 4 which is usually placed inside the watch band 2. Said connection cable 3 is a four-core cable, two cores of which are data leads and the other two are power leads.

Figure 4:
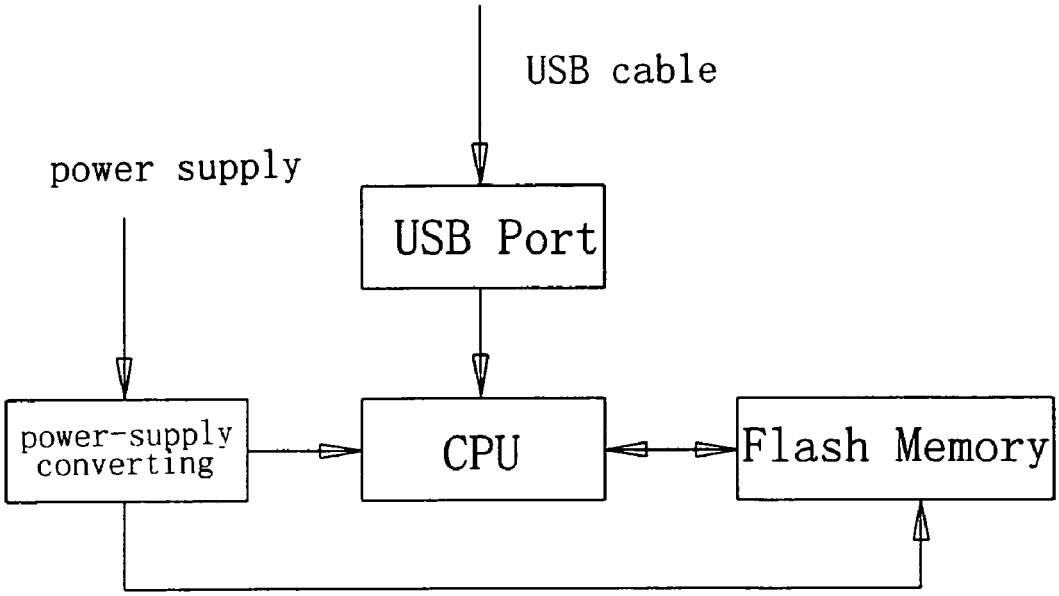
FIG. 4 is the principle circuit diagram of the wristwatch shown in FIG. 1*a;*

The principle electronic diagram is shown in FIG. 4: The flash memory circuit includes a CPU, a flash memory, a power-supply converting circuit and a USB port. When the USB connector is connected to a computer, the computer will supply power to power-supply converting circuit immediately, thereby supply power to the CPU and the flash memory. The CPU is used to control data processing, reading, storing and exchanging; the Flash Memory is used to store data, the USB port is the interface for data exchange between the Flash Memory and the computer. Under the control instruction of the CPU, data of the Flash Memory can be exchanged with that of the computer via the USB port, so as to realize data reading, storing and exchanging.

Since the flash memory circuit is highly integrated, the USB connector 4 and the connection cable 3 are both installed outside the watch body, compared with a conventional wristwatch, the size of the watch body of the present invention is hardly increased, therefore, the wristwatch of the present invention can still be made compact and exquisite.

As shown in FIGS. 1*a*, 1*b*, 2 and 3, the watch case has an opening hole 12, one end of the connection cable 3 connects with the circuit board 10, the other end of the connection cable 3 extends outside the watch body through the opening hole 12. The aperture of the opening hole 12 is greater than the diameter of the connection cable 3. For good looking, a cable cover 6 is placed above the connection cable 3 for enveloping the opening hole 12.

Figure 2:
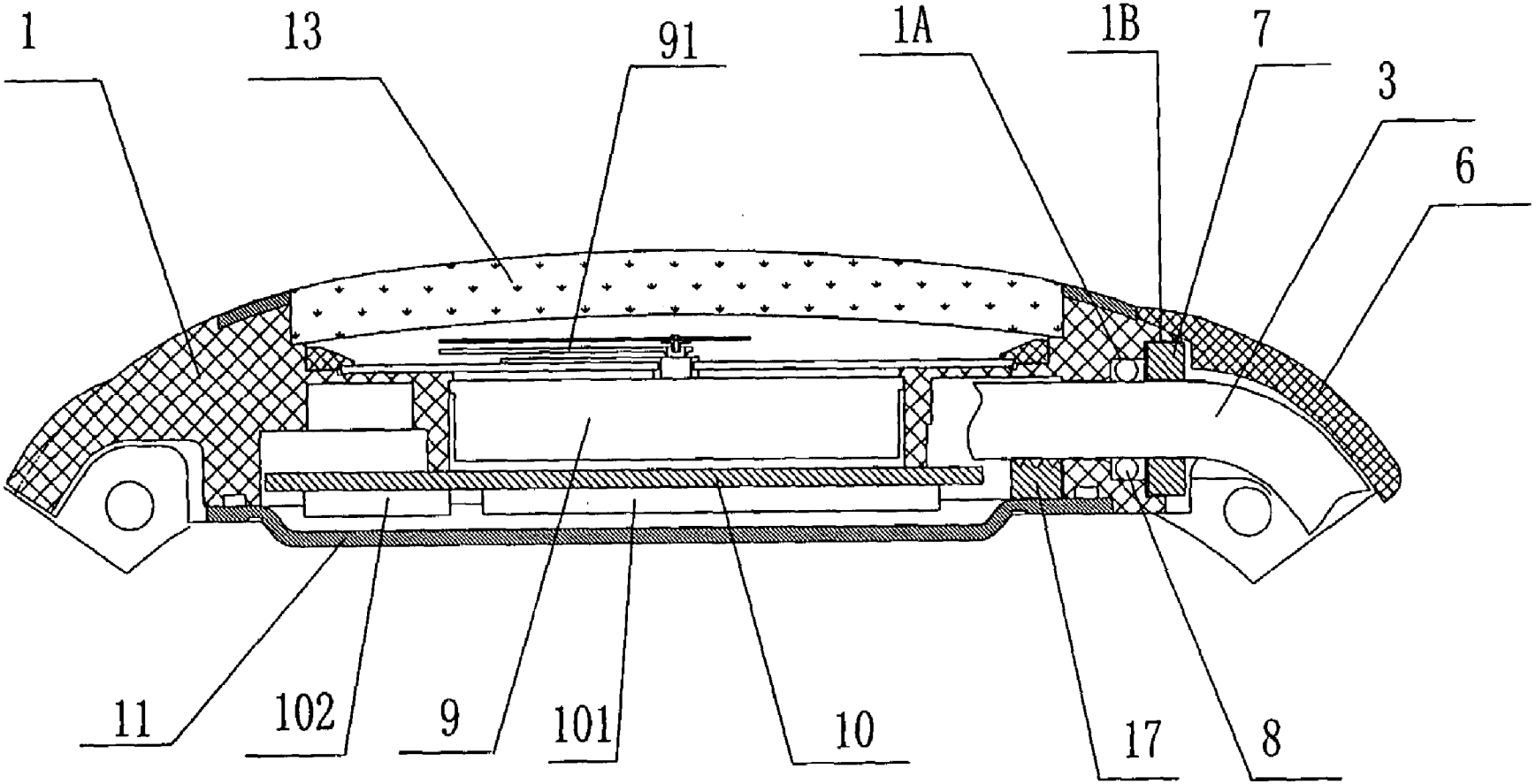
FIG. 2 is the sectional schematic view of the body of the wristwatch shown in FIG. 1*a;*
Figure 3:
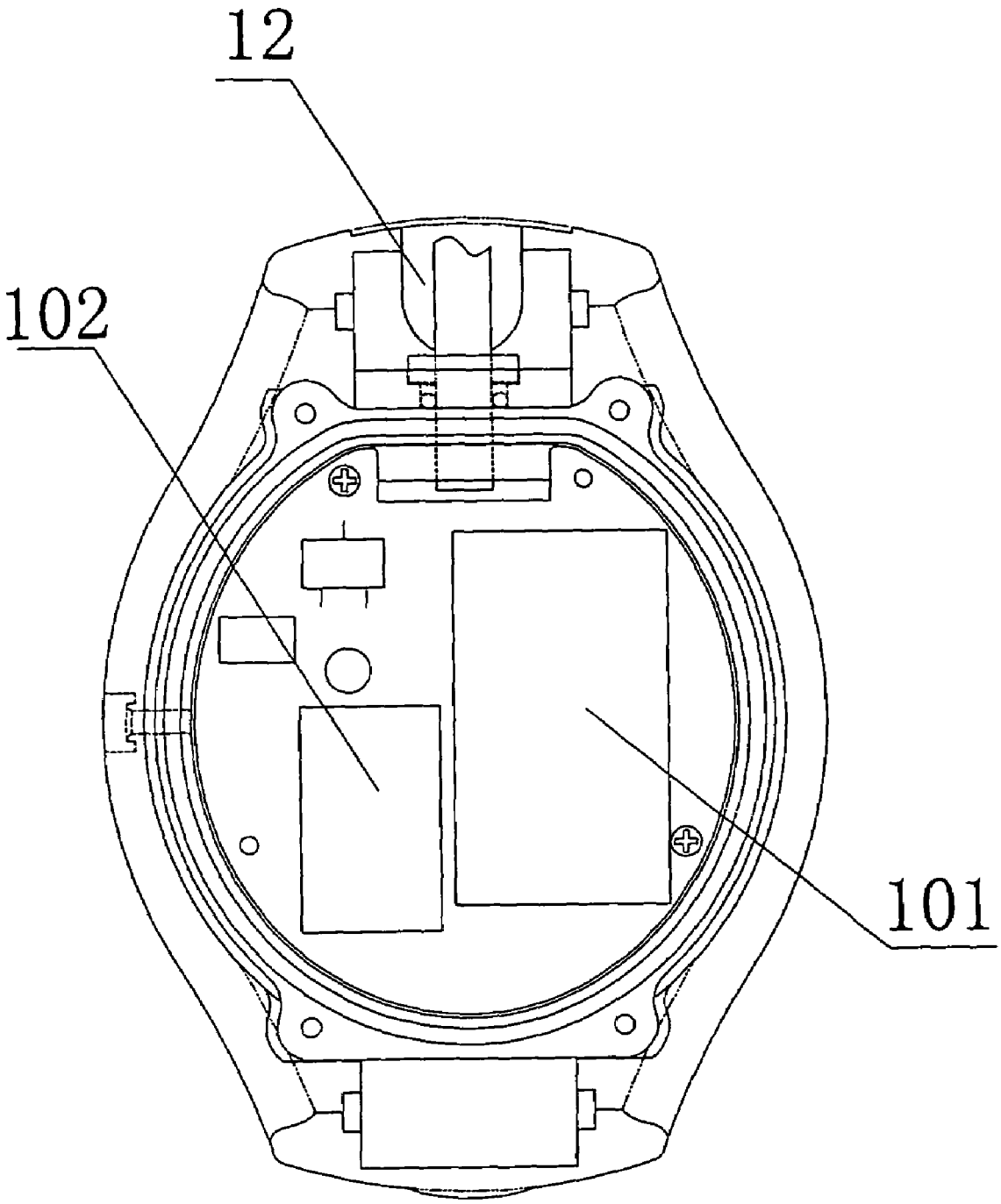
FIG. 3 is the schematic view of the wristwatch shown in FIG. 1*a* with the case back removed.

In order to keep the dryness of the electronic elements in the watch body, the outside part of the connection cable 3 should have excellent water proof property. The assembling steps of the wristwatch is as follows:

As shown in FIG. 2, at the outlet where the connection cable 3 extends outside, the watch case 1 has a step structure which consists of an inner step 1A and an outer step 1B. Firstly, place a water proof gasket 8 at the inner step 1A, wherein said water proof gasket 8 is a circular ring and is made of deformable materials such as rubber and plastics etc; next, press a circular ring sheeting 7 to the outer step 1B, where the sheeting 7 can be made of the same materials as the watch case, such as ABC, plastics etc; then, make the sheeting 7 fused with the watch case 1 by ultrasonic, so that the sheeting 7 can be sealed closely around the outlet. During the fusing by ultrasonic, the water proof gasket 8 deforms and its internal diameter becomes smaller than the external diameter of the connection cable 3; make the connection cable 3 pass through the opening hole 12, the sheeting 7 and the water proof gasket 8 in turn, insert it inside the watch body, and then connect it to the circuit board 10. Inside the watch body, a stowing piece 17 is placed to fix the connection cable 3, so as to position the connection cable 3 stably.

Figure 5:
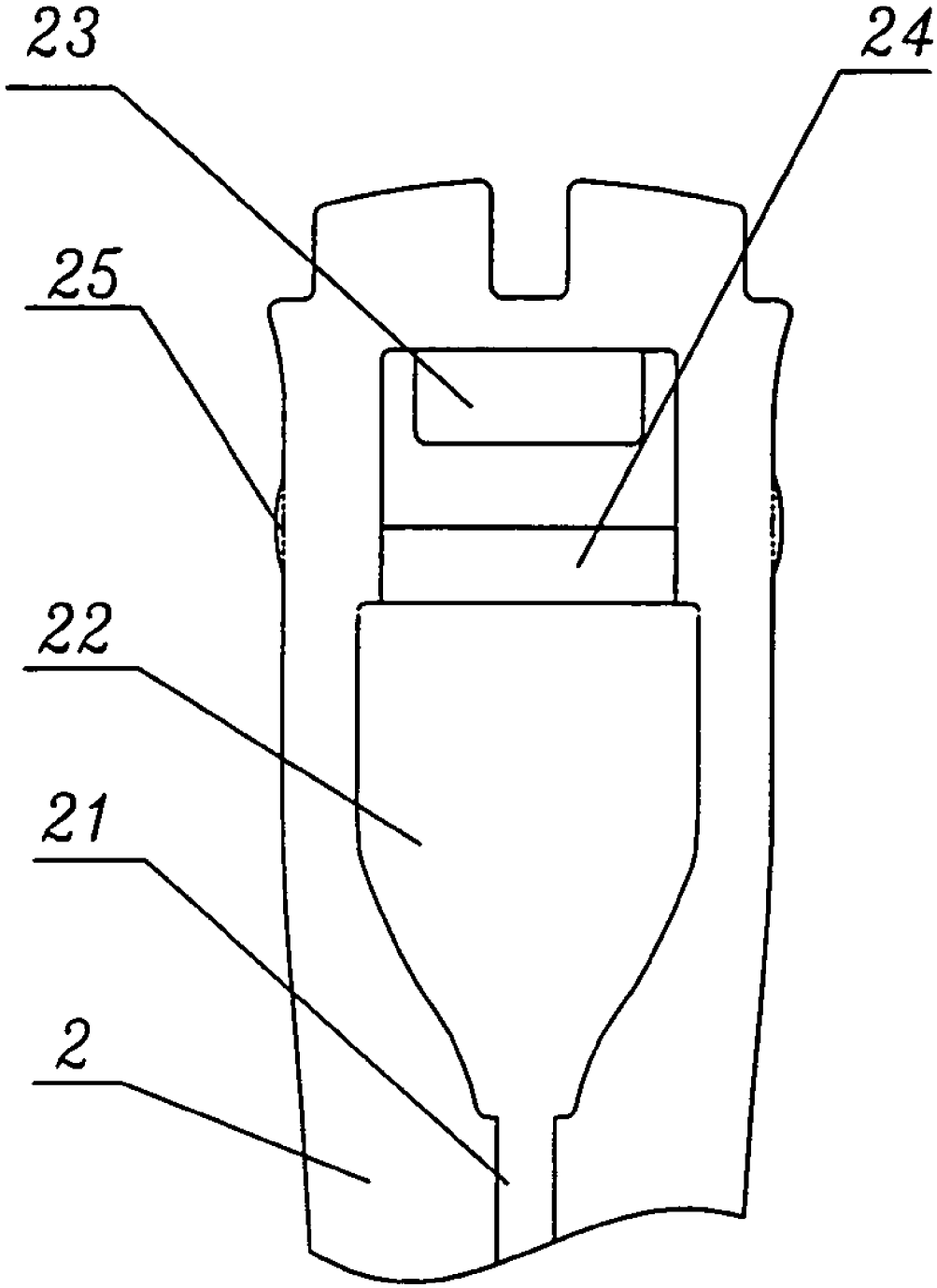
FIG. 5 is the schematic view of the watch band of a wristwatch capable of storing and transmitting data according to the present invention.
Figure 6:
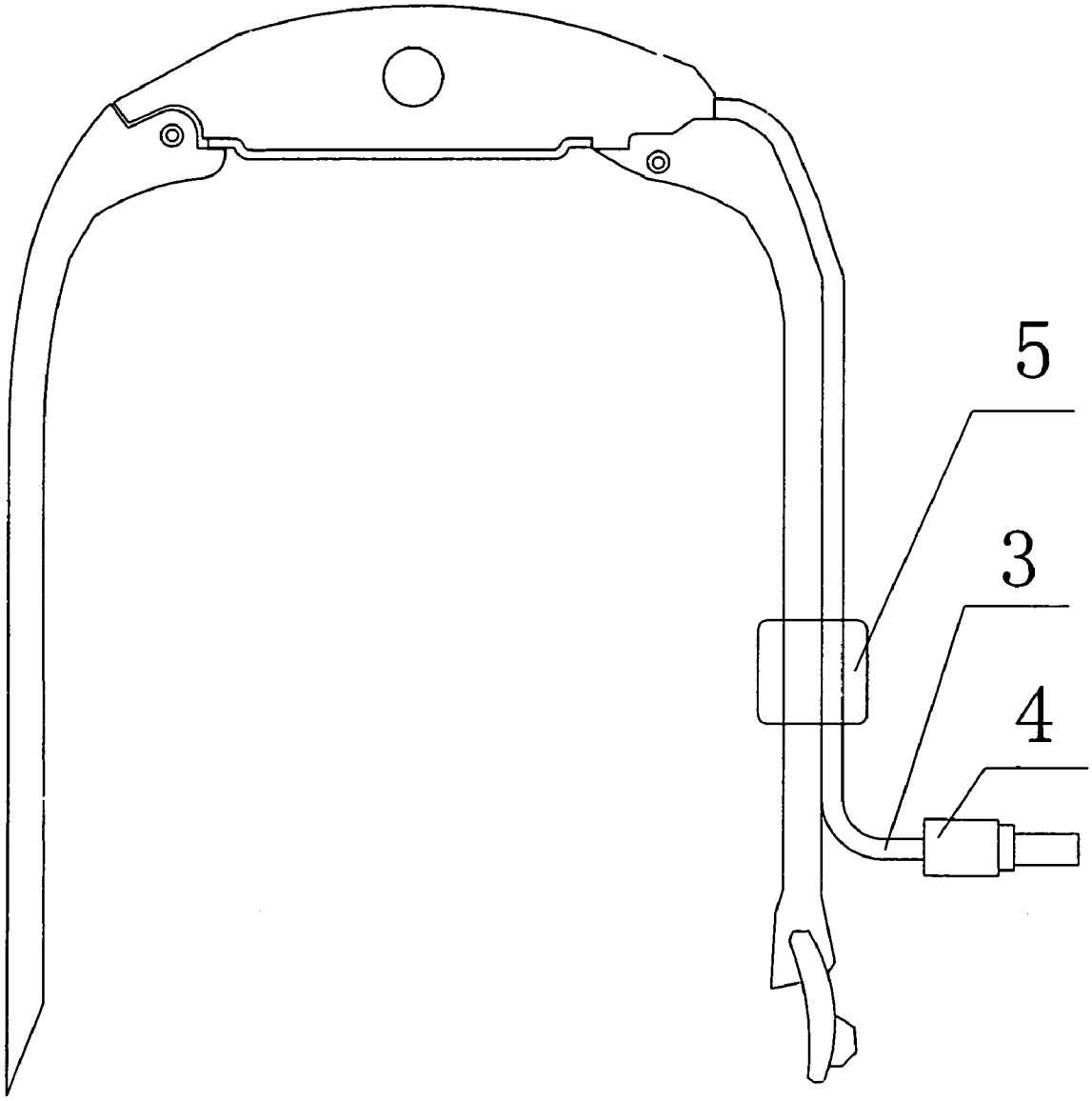
FIG. 6 is the schematic view of a wristwatch capable of storing and transmitting data according to the present invention, with the USB four-core cable and the USB connector taken out of the groove of the watch band after the loop is moved.
Figure 7:
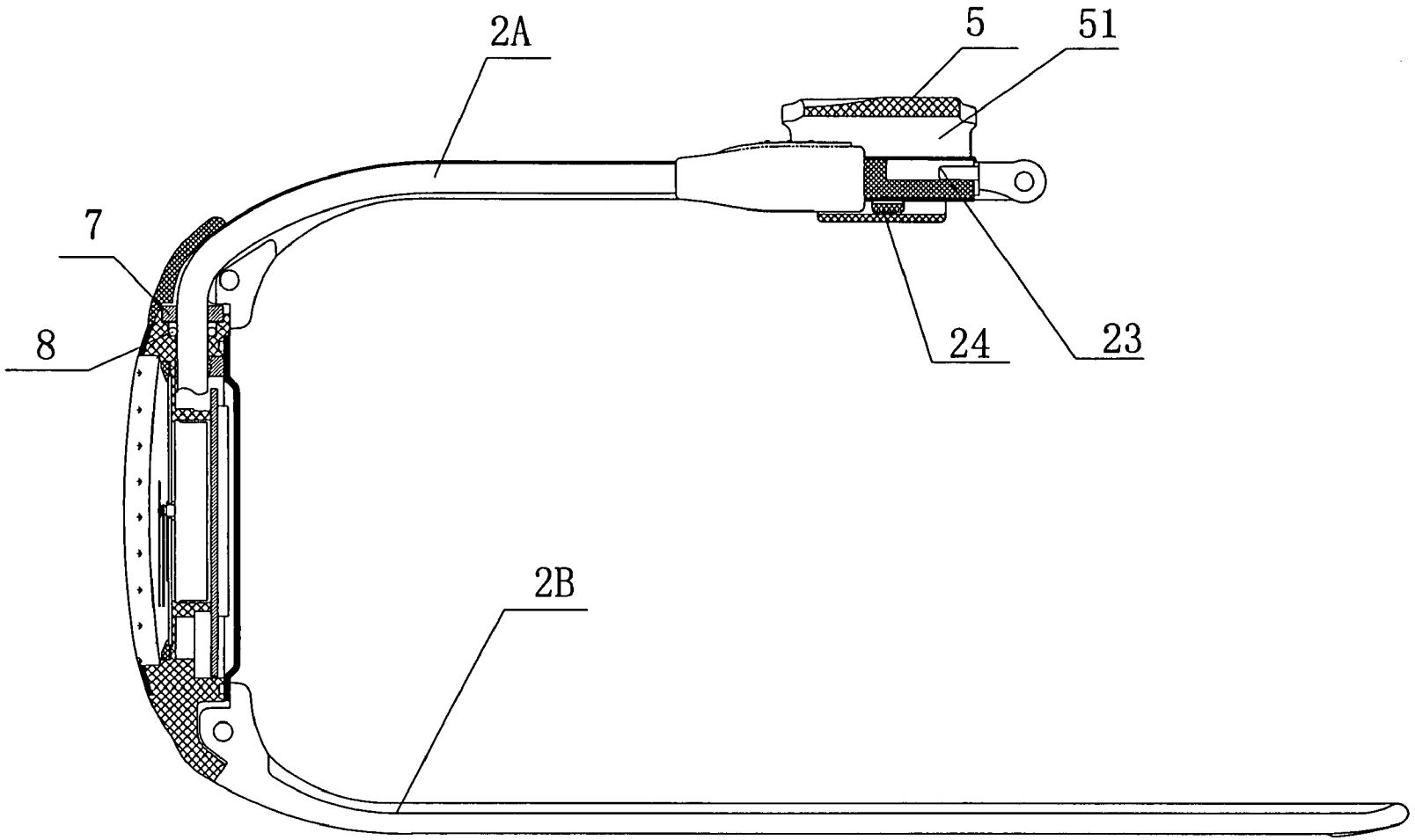
FIG. 7 is the schematic view of the wristwatch shown in FIG. 1*a* with the USB connector assembled.

As shown in FIGS. 5, 6 and 7, the watch band 2 includes two sections 2A and 2B. In order to adapt to the fixing of the connection cable 3 and the USB connector 4, and for purposes of easy carrying and better looking, following improvements are made in the section 2A: the section 2A is undercutting according to the outline of the connection cable 3 and the USB connector 4, so as to form a big through hole; said through hole is divided into two segments, wherein the longer segment 21 is made to house and closely lock the connection cable 3, the shorter segment 22 is formed to lodge the USB connector 4. Thus, the outside part of the connection cable 3 and the USB connector 4 are beset in the section 2A of the watch band. In order to further fix the USB connector 4, a tongue like positioning piece 23 is installed at the outside end of shorter segment 22 of the section 2A of the watch band. When the USB connector 4 is placed inside the groove of the shorter segment 22, the positioning piece 23 extends into the USB connector and locks it in position, thus the USB connector will not sway randomly. On section 2A of the watch band, a rib 24 is installed for linking the two segments of the section 2A and securing the USB connector, so that, the section 2A of the watch band is not easy to be damaged, and the USB connector can be further secured. Said watch band 2 is made of PU material.

The wristwatch of the present invention further includes a loop 5, which is designed to fit the size of the USB connector 4, and can be slid along the watch band 2. Several small pieces of projections 25 are provided on both sides of the watch band 2 at the segment 22, and correspondingly several small concaves are provided on the inner surface of the loop 5. When the small projections 25 are engaged with the small concaves, the loop 5 can be positioned precisely so as to clamp the USB connector 4 in the groove of segment 22. The assembling and fixing means for said connection cable 3 and the USB connector 4 includes the groove of longer segment 21, the groove of shorter segment 22, the loop 5, the tongue like positioning piece 23, the rib 24, the small projections 25 and the small concaves on the inner surface of the loop 5. As shown in FIG. 6, the steps for transmitting or storing data of computers are as follows: loose the loop 5 from the small projections 25 and move it to another position of the watch band 2, so that the USB connector 4 can get rid of the latch of the loop 5; then take out the USB four-core connection cable 3 and the USB connector 4 from the watch band 2, and plug the USB connector 4 into the corresponding USB port of a computer. When the above steps are finished, the required data such as, material, files and information, etc, can be copied and downloaded rapidly from the computer to the Flash Memory 101 by operations on the computer. All of the operations of copying, downloading, storage and transmission are completed under the control of CPU 102.

After the data loading is finished, pull the USB connector 4 out from the corresponding USB port of the computer, then press the USB four-core connection cable 3 into the groove of segment 21, put the USB connector 4 into the groove of segment 22, and wrap it with the loop 5, so as to avoid damage to the USB connection cable and the USB connector even when the wristwatch wearer is playing sports. The loop 5 is made of harder material than the watch band 2, such as ABS, PC plastics, so that to satisfy the functional requirements of the watch band.

As shown in FIG. 7, the upper part of the inner cavity of the loop 5 is an empty cavity 51. When the wristwatch is worn on one's wrist, the tail end of the section 2B of the watch band 2 can be inserted into the empty cavity 51, so as to adjust the degree of tightness of the wristwatch.

CPU, Flash Memory, USB four-core cable and USB connector can be chosen from the standard units, or they can be custom made according to special specs, so that they may be fit in the watch case easily, which increase the practicability of the present invention. In addition, at the clearance of the seam between the watch case and the watch band from which the USB four-core cable extends, a sealing gasket (water proof gasket) and a press sheeting are used, so that the CPU, Flash Memory, the corresponded circuit and other elements in the watch case can be protected. Therefore, the wristwatch is watertight and moisture-resistant. Specially, the wristwatch according to the present invention should be made of plastic. The material of watch case or watch band is ABS. The superduper insulating property of the ABS ensures the electric property of the wristwatch of the present invention, so that mistakes can be avoided when data is loaded and transmitted through the CPU 1 and Flash Memory 2. Thus, the wristwatch of present invention, which integrates the traditional wristwatch with a USB Flash Memory device, possesses functions of rapid data transmission and storage in addition to the timing function. The wristwatch of the present invention has more functions than the traditional one, and is more convenient than an individual external hard disk or the existing portable storage product.

Embodiment II

Embodiment 2 is different from Embodiment 1 in that, the watch case 1 and the sheeting 7 are both made of metal, while the watch band 2 can be made of either metal or plastics. The structures of the metal watch case 1 and the watch band 2 are the same as those in Embodiment 1. But the sealing structure of the seam from which the USB four-core cable extends is different from that in Embodiment 1. Since the sheeting 7 and the watch case 1 are made of metal, internal threads are provided inside the step 1B of the watch case 1 and external threads are provided on the outer circumference of the sheeting 7. When mounting the sheeting 7, the sheeting 7 is joined to the watch case 1 by screw so as to form an integrated body, thereby, the water proof gasket 8 is pressed and deformed to seal the wristwatch.

Embodiment III

Embodiment 3 relates to a wristwatch (digital watch) which displays time with a LCD (liquid crystal display screen). The structure of its time indicating component is different from the analog wristwatch of Embodiment 1, which causes differences on its whole structural layout. The IC of the LCD wristwatch is installed on the circuit board, and is combined with the LCD display screen to form the wristwatch. Thus, the circuit board of the wristwatch and the circuit board of the flash memory can be designed integratedly. Compared with Embodiment 1, in addition to the flash memory and the CPU, a time-control IC for controlling the LCD to indicate time is further included in the circuit board assembly in Embodiment 3.

Figure 8:
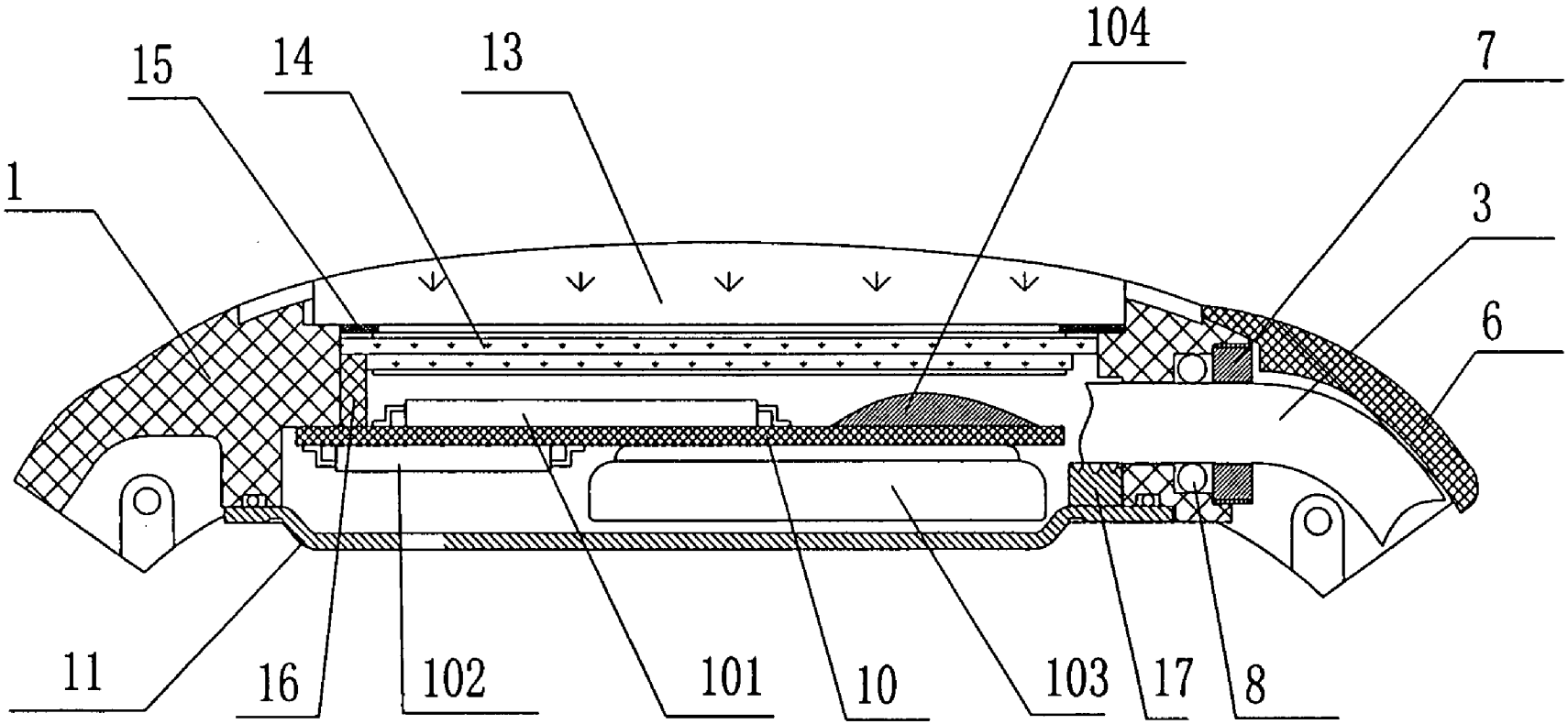
FIG. 8 is the schematic view of the body of a wristwatch capable of storing and transmitting data according to embodiment III of the present invention.

FIG. 8 is a schematic view of a digital watch. The watch consists of a watch case 1, a name plate 15, a liquid crystal display screen 14, a lens 13, a time-control IC 104, a sheeting 7, a USB connection cable 3, a cable cover 6, a water proof gasket 8, a stowing piece 17, a battery 103, a circuit board 10, a flash memory 101, a CPU 102, a conductor rubber 16, a case back 11.

The battery 103, circuit board 10, time-control IC 104, liquid crystal display screen 14 and name plate 15 constitute the time indicating component.

Said flash memory 101 and said CPU 102 can be installed on each side (upper side or under side) of the circuit board 10 respectively, or both on the same side of the circuit board 10. FIG. 8 shows only one of the schemes.

Since the flash memory 101, the CPU 102 and the time-control are all installed on the circuit board 10, the integrated wristwatch has a more compact internal structure and a smaller volume.

Embodiment IV

Figure 9:
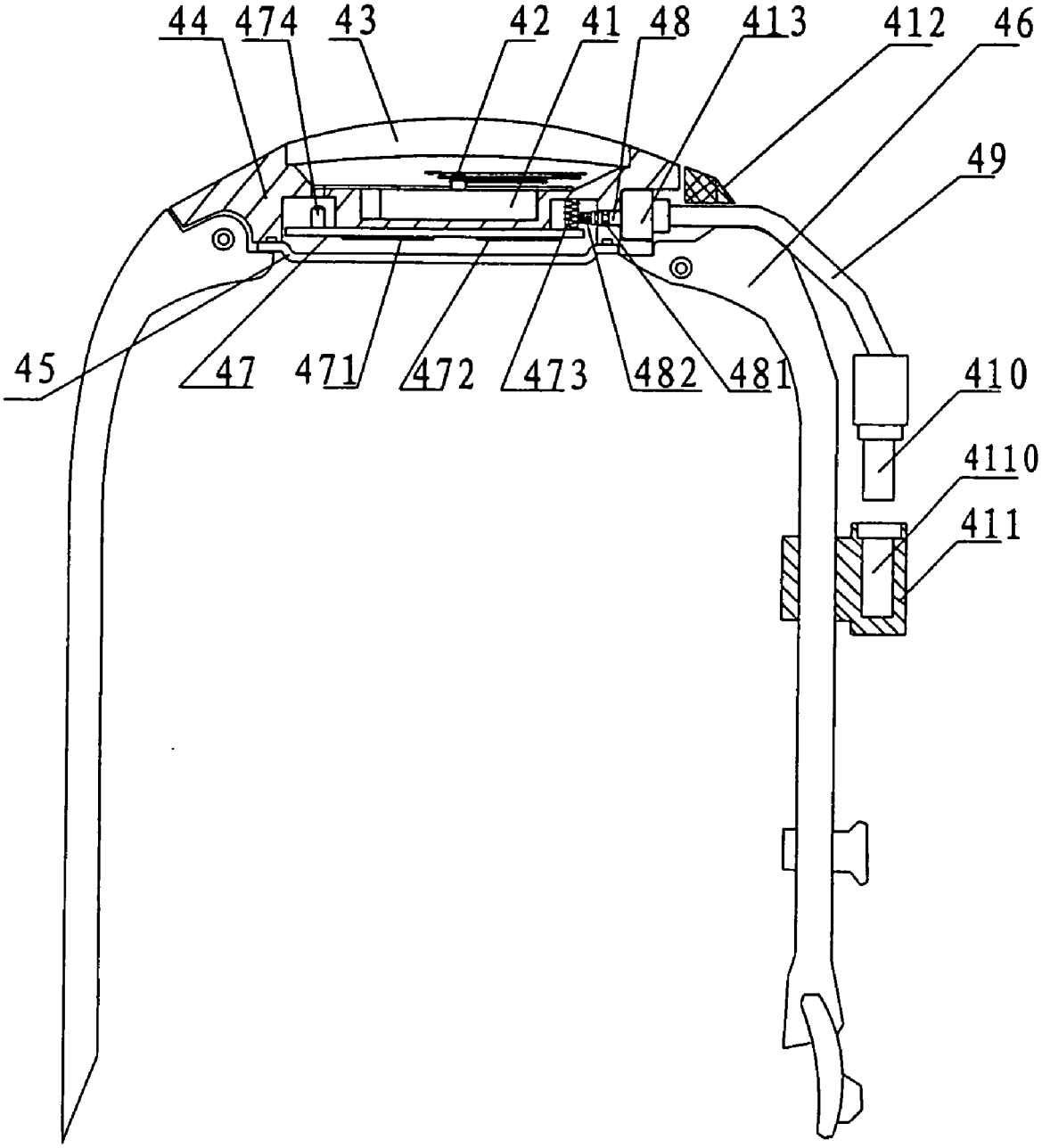
FIG. 9 is the schematic view of the wristwatch capable of storing and transmitting data according to embodiment IV of the present invention.

As shown in FIG. 9, the wristwatch according to this embodiment is an analog watch, consists of a time movement 41, hands 42, a transparent lens 43, a watch case 44, a case back 45 and a watch band 46. The time movement 41 and the hands 42 constitute the time indicating component of the wristwatch, the transparent lens 43, the watch case 44 and the case back 45 constitute the shell of the wristwatch.

The wristwatch further includes a flash memory circuit board assembly 47 and a USB connector assembly, said USB connector assembly includes a water proof pusher 48, a USB connection cable 49 and a USB connector 410, one end of the USB connection cable 49 connects with the water proof pusher 48, the other end of it connects with the USB connector 410. The water proof pusher 48 is installed in the opening hole of the watch case, and extends inside the watch case of the wristwatch, then further connect with the flash memory circuit board assembly 47. The aim to adopt the water proof pusher 48 in the wristwatch is to achieve excellent water proof performance, as the water proof pusher is used as the functional key in the existing wristwatch of high water proof performance. The time movement 41, the hands 42 and the flash memory circuit board assembly 47 are installed inside the watch case of the wristwatch, the flash memory circuit board assembly 47 is located under the time movement 41, the assembly 47 includes a central processing unit (CPU) 471, a flash memory 472, an indicator light 474 and a spring bar 473, wherein the spring bar 473 is the connecting point of the circuit. The operational principle of the flash memory circuit board assembly 47 is the same as that of the prior flash memory. The indicator light 474 provides indication to users during transmitting and storing operation, and accordingly the components over the indicator 474 are also transparent. Said water proof pusher 48 are equipped with a water proof gasket 481 and a spring bar 482, said water proof gasket 481 fills the gap between the water proof pusher 48 and the opening hole of the watch case, said spring bar 482 connects with the spring bar 473 of the flash memory circuit board assembly 47. The watch band 46 is wrapped with a cover 411 which has a cavity 4110 for receiving the USB connector 410. Moreover, the cover 411 can protect the USB connector from dust and water. The cover 411 can also function as securing means for the USB connector assembly. The USB connector is usually kept in the cavity 4110 of said cover 411, and when loading, transmitting or storing data, the cover 411 is removed, and the USB connector 410 is plugged to the corresponding USB port of a computer. Since the USB connector 410 of the wristwatch can be directly plugged into the USB port of the computer, the user can realize data flash memory anytime and anywhere without a long cable additionally. Furthermore, a fixing block 412 is provided at the engagement position between the watch case and the watch band to cover and fix the USB connection cable 49.

Figure 10:
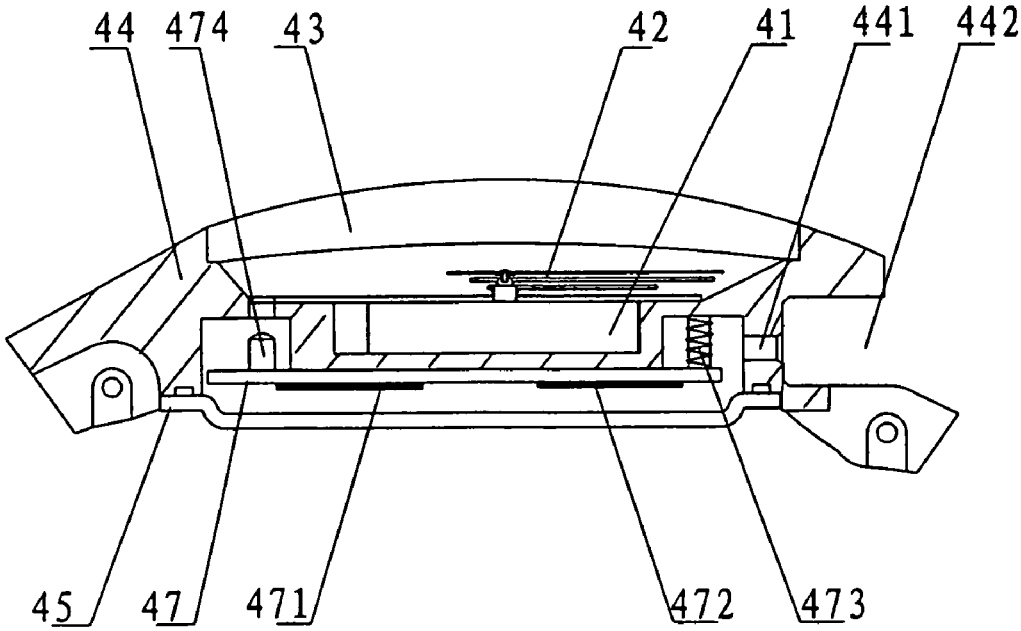
FIG. 10 is the sectional schematic view of the wristwatch shown in FIG. 9 without the watch band and the USB connector.

FIG. 10 shows the sectional schematic view of this embodiment without the watch band and the USB connector assembly. In the watch case, an opening hole 441 connected with an outwards groove 442 is provided, said opening hole 441 is used to install the water proof pusher 48.

Figure 11:
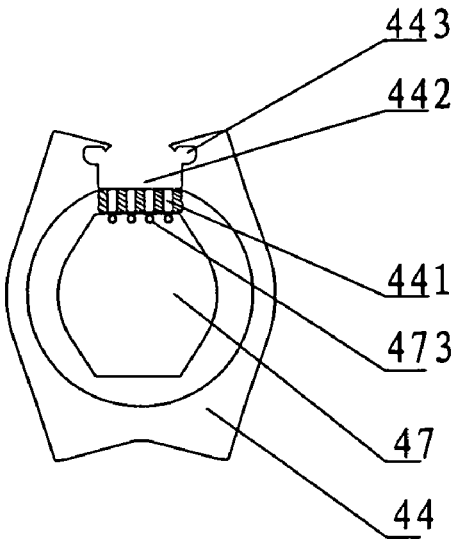
FIG. 11 is the lateral schematic view of the wristwatch shown in FIG. 10.

As shown in FIG. 11, the flash memory circuit board assembly 47 has a spring bar 473 used as the circuit connecting point. The watch case 44 has four opening holes 441 connected with an outwards groove 442, on each of the two sides of the groove 442, a fixing hole 443 is provided for inserting the fixing bars 414.

Figure 12:
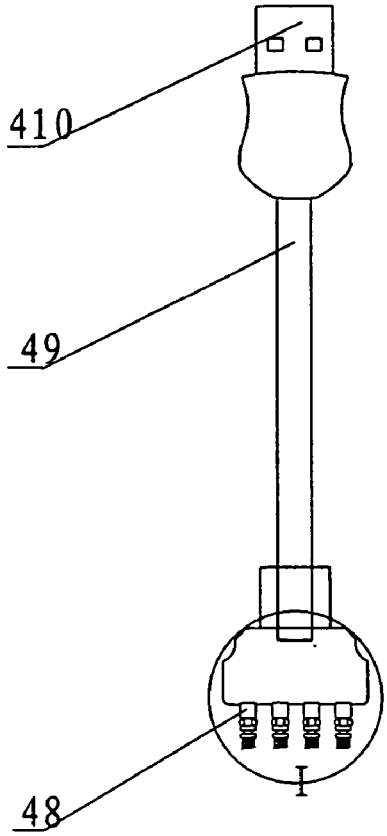
FIG. 12 is the schematic view of the USB connector of the wristwatch shown in FIG. 9.

As shown in FIG. 12, the USB connector assembly includes a set of water proof pushers 48, a USB connection cable 49 and a USB connector 410.

As shown in FIG. 12, as the USB connection cable 49 is a four-core cable with four ends, the water proof pusher 48 has four ends. Each end of the water proof pusher 48 connects with the end 490 of one core of the USB connection cable 49, and on each end of the water proof pusher 48 is provided with a water proof gasket 481 and a spring bar 482. The connection part between the water proof pusher 48 and the USB connection cable 49 is enveloped by a outer covering 413, so as to seal and protect the water proof pushers 48 and the ends 490 of the USB connection cable 49 connecting thereto. The outer covering 413 has a groove 4130 on each side so as to form a sealing structure when inserting the fixing bars 414 into the fixing holes 443 of the watch case. When the water proof pusher 48 is inserted into the opening hole 441, the water proof gasket 481 fills the gap between the water proof pusher 48 and the opening hole 441, which ensures an airtight structure and prevents water or moisture from entering into the watch case.

Figure 13:
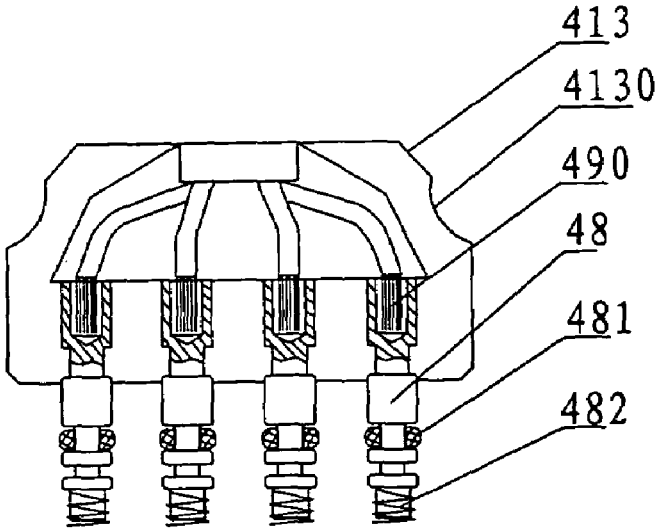
FIG. 13 is the enlarged view of part I of FIG. 12.
Figure 14:
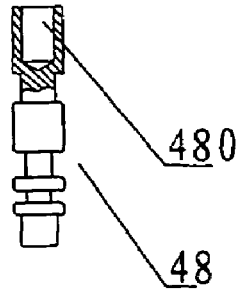
FIG. 14 is the schematic view of the water proof means of the wristwatch shown in FIG. 9.

As shown in FIG. 13 and FIG. 14, each end of the water proof pusher 48 has a hole 480 to be connected with the corresponding end 490 of the connection cable 49, said end 490 of the USB connection cable 49 is inserted into said hole 480 and secured with conductive material such as soldering tin, so as to ensure the electricity conductivity of the connection between the end 490 and the water proof pusher 48.

Figure 15:
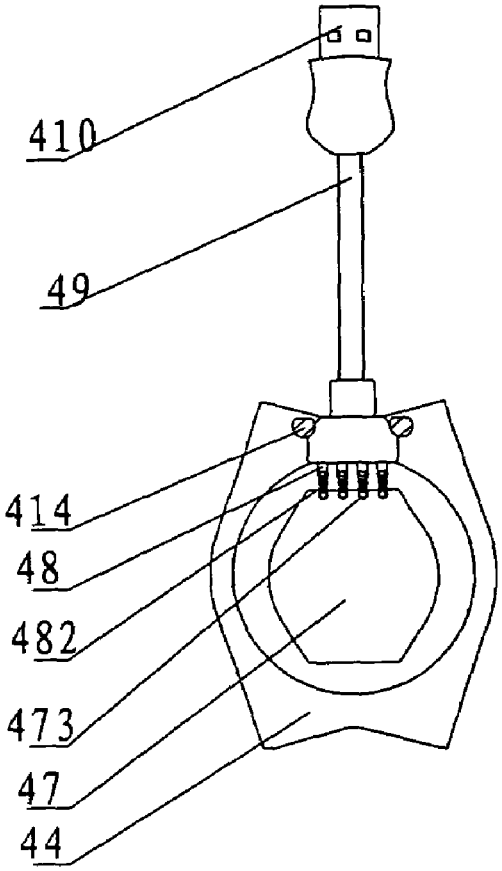
FIG. 15 is the lateral schematic view of the wristwatch shown in FIG. 9.

As shown in FIG. 15, each spring bar 482 of the water proof pusher 48 is connected with the spring bar 473 of the flash memory circuit board assembly 47, thereby the USB connector assembly and the flash memory circuit board assembly 47 are connected.

As shown in FIG. 11, FIG. 12 and FIG. 15, four ends of the water proof pusher 48 are inserted into the four opening holes 441 respectively, and the outer covering 413 is inserted into the groove 442. The fixing bar 414 is inserted into the space between the groove 4130 of the outer covering 413 and the fixing hole 443 of the watch case 44, so that, one end of the USB connector assembly is fixed.

It should be noted that the cover 411 can be a separate component, instead of adhering to the watch band. If the USB connection cable 49 is relatively longer, the cover 411 can be fixed somewhere on the watch band 46 to secure the USB connector 410, and the USB connector 410 can be taken out from the cover 411 when using.

Embodiment V

Figure 16:
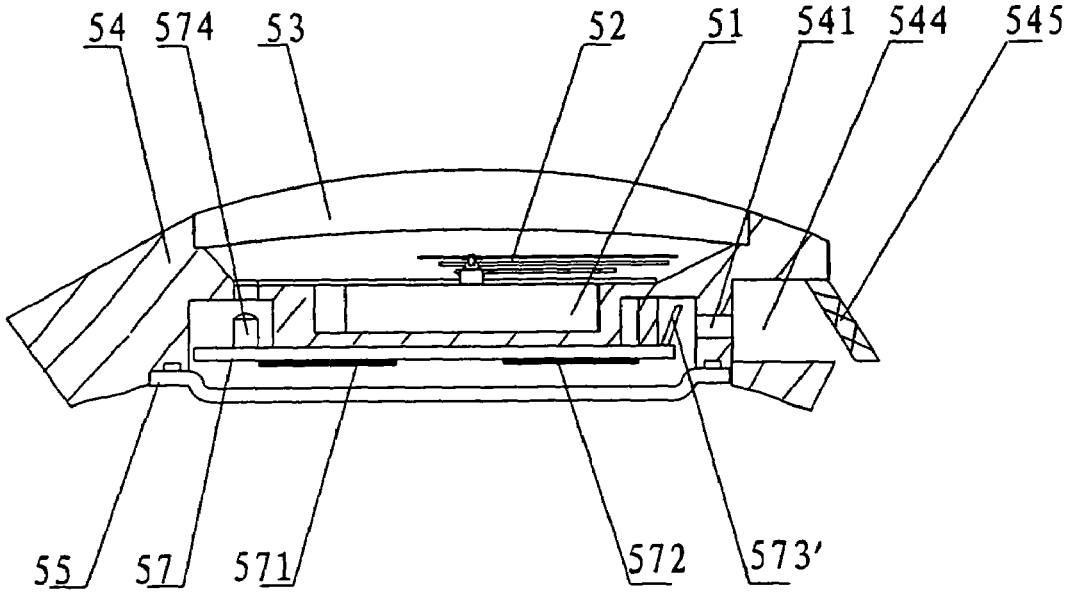
FIG. 16 is the sectional schematic view of the wristwatch capable of storing and transmitting data according to embodiment V of the present invention without USB connector.

As shown in FIG. 16, the wristwatch of this embodiment includes a time movement 51, hands 52, a watch case 54, a case back 55 and a flash memory circuit board assembly 57, the flash memory circuit board assembly 57 includes a central processing unit 571, a flash memory 572, a conductive spring sheet 573' and an indicator light 574. The watch band of the wristwatch of this embodiment is not shown in the figures. In the watch case 54, an opening hole 541, a groove 544 and a cover 545 are connected in turn and extend outwards. Said opening hole 541 is used for receiving the water proof pusher 58; said groove 544 is used for housing the USB connector 510. Since the USB connection cable is a four-core cable with four ends, the number of said opening hole 541 is four correspondingly, which can not be seen entirely in the sectional view. The locating position of the four opening holes 541 is the same as those in the embodiment IV shown in FIG. 11.

Figure 17:
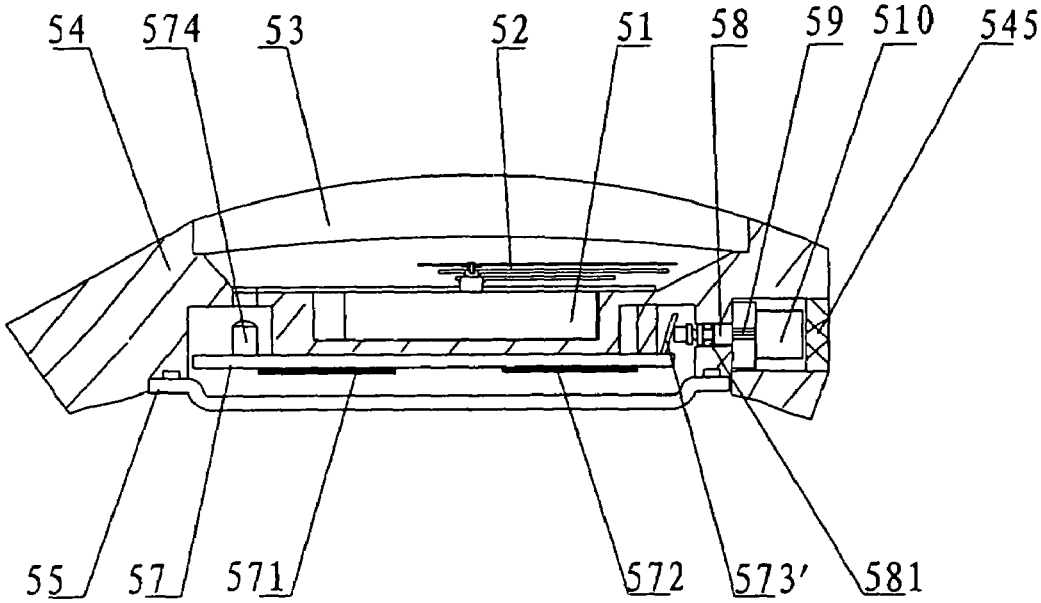
FIG. 17 is the sectional schematic view of the wristwatch capable of storing and transmitting data according to embodiment V of the present invention with a USB connector assembled.

As shown in FIG. 17, the wristwatch of this embodiment comprises a USB connector assembly, said USB connector assembly includes a water proof pusher 58, a USB connection cable 59 and a USB connector 510. One end of the USB connection cable 59 connects with the water proof pusher 58, while the other end connects with the USB connector 510. Said USB connection cable 59 is a four-core cable, so there are four ends of the water proof pushers 58 accordingly, which can not be seen entirely in the sectional view. Since the USB connection cable 59 is very short in length and the USB connector 510 is inserted inside the groove 544, an extra extension cable must be provided for connecting the USB connector 510 and the USB port of a computer. With the structure formed by the water proof pusher 58 and the water proof gasket 581, the internal elements of the wristwatch can still be sealed, and thus an excellent water proof performance can be achieved.

As shown in FIG. 16 and FIG. 17, the water proof pusher 58 is inserted in the opening hole 541, the USB connector 510 is inserted in the groove 544. The gap between the water proof pusher 58 and the opening hole 541 is filled with the water proof gasket 581; one end of the water proof pusher 58 connects with the spring sheet 573' of the flash memory circuit board assembly. The groove 544 is covered by the cover 545, which can protect the inside USB connector 510, especially from dust.

Furthermore, the connecting point of the flash memory circuit board assembly of the wristwatch of the present invention can be either a spring bar or a conductive spring sheet, or other types. The wristwatch according to the present invention can be either an analog watch or a digital watch, the time indicating component of the latter consists of an integrated circuit (IC) and a liquid crystal display screen (LCD).

Embodiment VI

In this embodiment, a MP3 player and a Flash Memory are integrated into the wristwatch.

Figure 18:
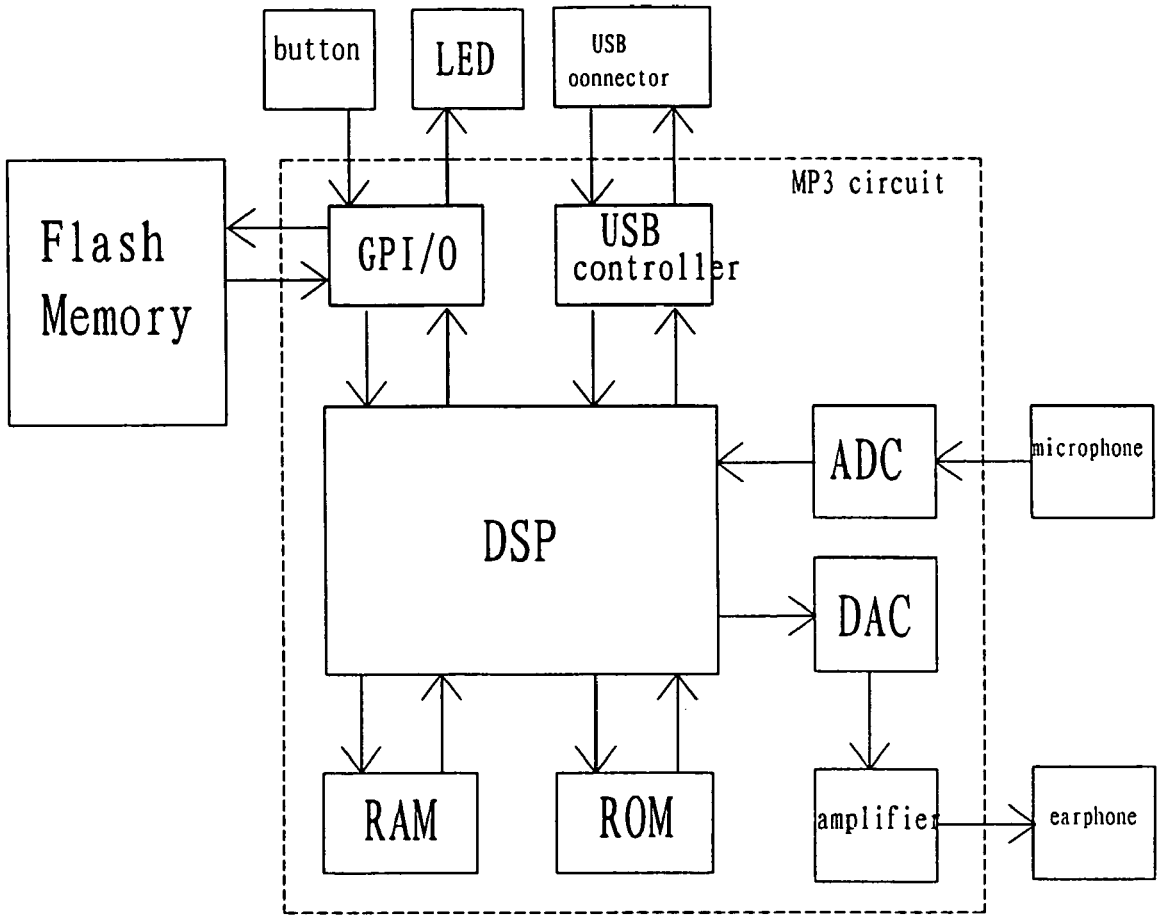
FIG. 18 is a function block of the wristwatch according to embodiment VI of the present invention.

As shown in FIG. 18, there are two main CMOS chips in the wristwatch of the invention: one is a flash memory; the other is a MP3 CMOS chip. The MP3 CMOS chip comprises a DSP, a USB controller (or a CPU), an ADC, a DAC, a RAM, a ROM, a GPI and so on. The outlet of the ADC connects to the microphone, and the DAC connects to the earphone via the amplifier. The MP3 CMOS chip communicates (upload, download) data with the outer data equipment (such as computer) via the USB connector, and some music files of the MP3 form and some computer information of other forms can be stored in the flash memory. In detail, the wristwatch of the invention uses the USB connector for connecting the computer USB port, and uses the CPU for transmitting data to the DSP. The DSP transmits the processing data to the flash memory via the GPI. When it records, the microphone transmits the sound to the ADC, and the ADC transmits the data to the DSP after the analog-to-digital conversion. The DSP stores the data in the flash memory.

When the music files (such as MP3) are played, the DSP reads the music data from the flash memory and the data is processed via the DAC, the amplifier in turn, and then the music comes out from the earphone. The GPI further connects with the LED lamps for piloting working state and the button for controlling the working state. That is to say, the users can fulfill the music playing, the song selecting, going forward and backing up, the data uploading and downloading, the files editing and so on by press the button on the side of the watchcase. The LED lamps can show the working state respectively or conjunctly. In the embodiments of the invention, the flash memory, such as the Toshiba TC58512FT and the Samsung K9F1208U0M, which can be brought from market, is used. It will be more convenient to use the MP3 CMOS chip integrating the ADC, the DAC and other components in one IC, such as SIGMA STMP3410, STMS1342.

Figure 19A:
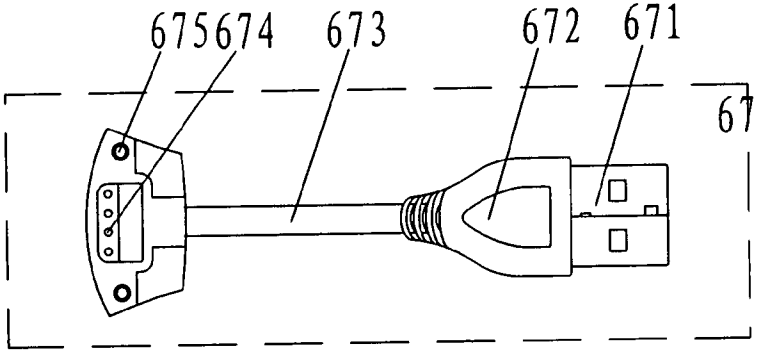
FIG. 19*a* is a back view of the USB connector assembly of the wristwatch according to embodiment VI of the invention.
Figure 19B:
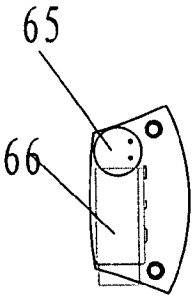
FIG. 19*b* is a back view of the microphone and the earphone socket assembly of the wristwatch according to embodiment VI of the invention.
Figure 19:
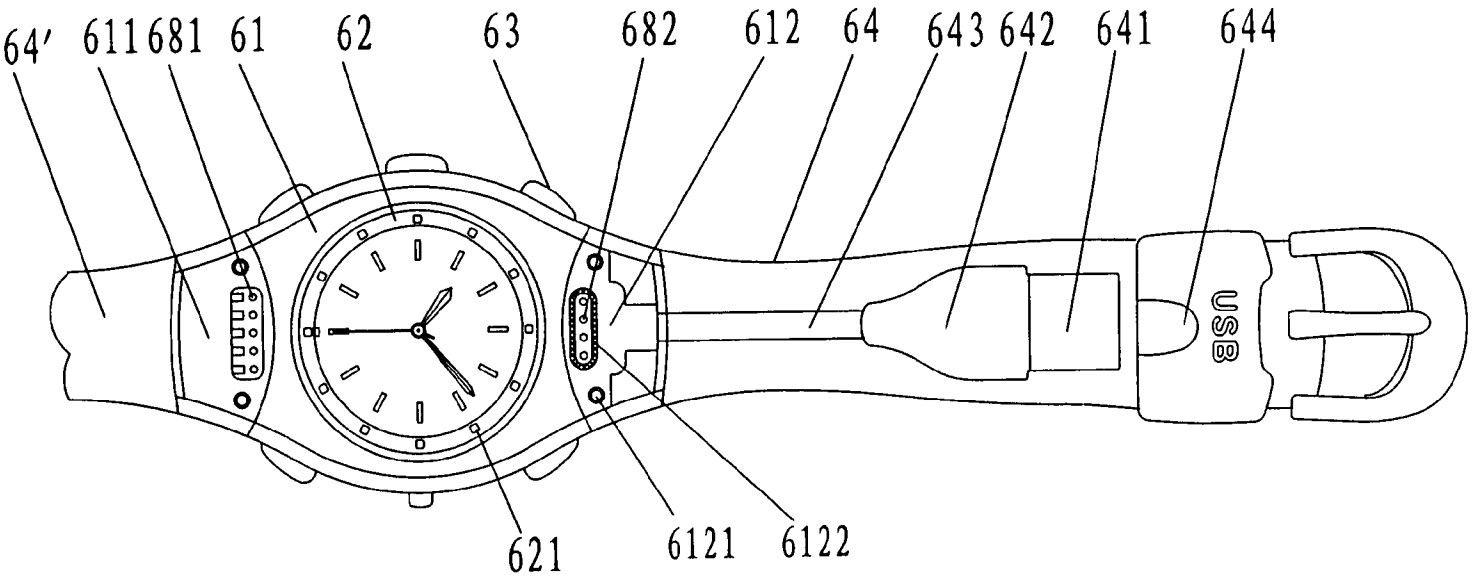
FIG. 19 is a front view of the wristwatch according to embodiment VI of the invention.

As shown in FIG. 19, the front view of the wristwatch according to the invention, we can see a watchcase 61, a reflect light circle 62 below the lens, some buttons 63 on the side of the watchcase 61, a watchband 64, a watchband 64'. The buttons 63 can be used for controlling the working state such as MP3 music playing, data storage. A concave step 611 for installing the plug of the microphone and the earphone, and a concave step 612 for installing the USB connector assembly are made in the two sides, near the watchband 64 and the watchband 64', of the watchcase 61. As the circuit connecting point, the top of the water proof button 681 is located on the surface of the concave step 611. As the circuit connecting point, the top of the water proof button 682 is located on the surface of the concave step 612. A gasket 6122 around the water proof button 682 is placed on the concave step 612. The concave step 612 further includes screw holes 6121. The reflect light circle 62 has some fluorescence points 621 for irradiating the time in the night. The number of the fluorescence points 621 is the same as the number, commonly, twelve, of the scales on the dial. Some LED lamps (not shown in FIG. 19) placing under the fluorescence points 621 are used for piloting the working state such as music playing and data transmitting. Grooves 641, 642, 643 for installing the USB connector, the connector socket, the USB cable respectively are made in the watchband 64. In this embodiment, the grooves 641, 642 and 643 are not hollow, so that, they can hold the USB connector and the USB cable perfectly. A colligated ring 644 for protecting the USB connector is made in one end of the watchband 64, it can ring the USB connector holding in the groove 641.

As shown in FIG. 19*a*, the wristwatch of the invention provides a USB connector assembly 67 that is processed single, it is convenient for replacing when repairing or maintaining is need. The USB connector assembly 67 is made up of a USB connector and a USB cable. In detail, the USB connector assembly 67 includes a USB connector 671 for connecting the USB port of the equipment such as computer, a connector socket 672, a USB cable 673 and some circuit connecting points. Combine the FIG. 19 and the FIG. 19*a*, one end of the USB connector assembly 67 connects with the water proof button 682 of the concave step 612 of the watchcase 61 via the circuit connecting points. The USB connector 671, the connector socket 672 and the USB cable 673 of the USB connector assembly 67 are placed in the grooves 641, 642 and 643 respectively. The colligated ring 644 of the watchband 64 can move to the groove 641 and ring the USB connector installing in the groove 641. When the data need to be transmitted (such as download the MP3 music files from the computer), remove the colligated ring 644 and pinch the connector socket 672. Therefore, the USB connector 671 and the USB cable 673 can be took out from the groove 641 and the groove 643. The end containing circuit connecting points 674 of the USB connector assembly 67 can be injected as a cover form. The cover matching the concave step 612 of the watchcase 61 has two screw holes 675 matching the screw holes 6121 of the concave step 612 of the watchcase 61, so, the cover can be fixed by the screws. The cover is installed on the concave step 612 of the watchcase 61, the circuit connecting points is connected to the water proof button 682 and the gasket 6122 is filled between the cover and the concave step 612 of the watchcase 61.

As shown in FIG. 19*b*, the invention provides a microphone 65 and an earphone socket 66 assembly that are processed single. The assembly is integrated injected as a cover form matching the concave step 611 of the watchcase 61, and the bottom of the cover has a microphone 65 and an earphone socket 66. The matching screw holes can be made in the cover and the concave step 611 of the watchcase 61, and the microphone 65 and the earphone socket 66 can be installed tightly on the concave step 611 by the screws. The microphone 65 and the earphone socket 66 connect to the water proof button 681 of the concave step 611 of the watchcase 61 respectively.

Figure 20:
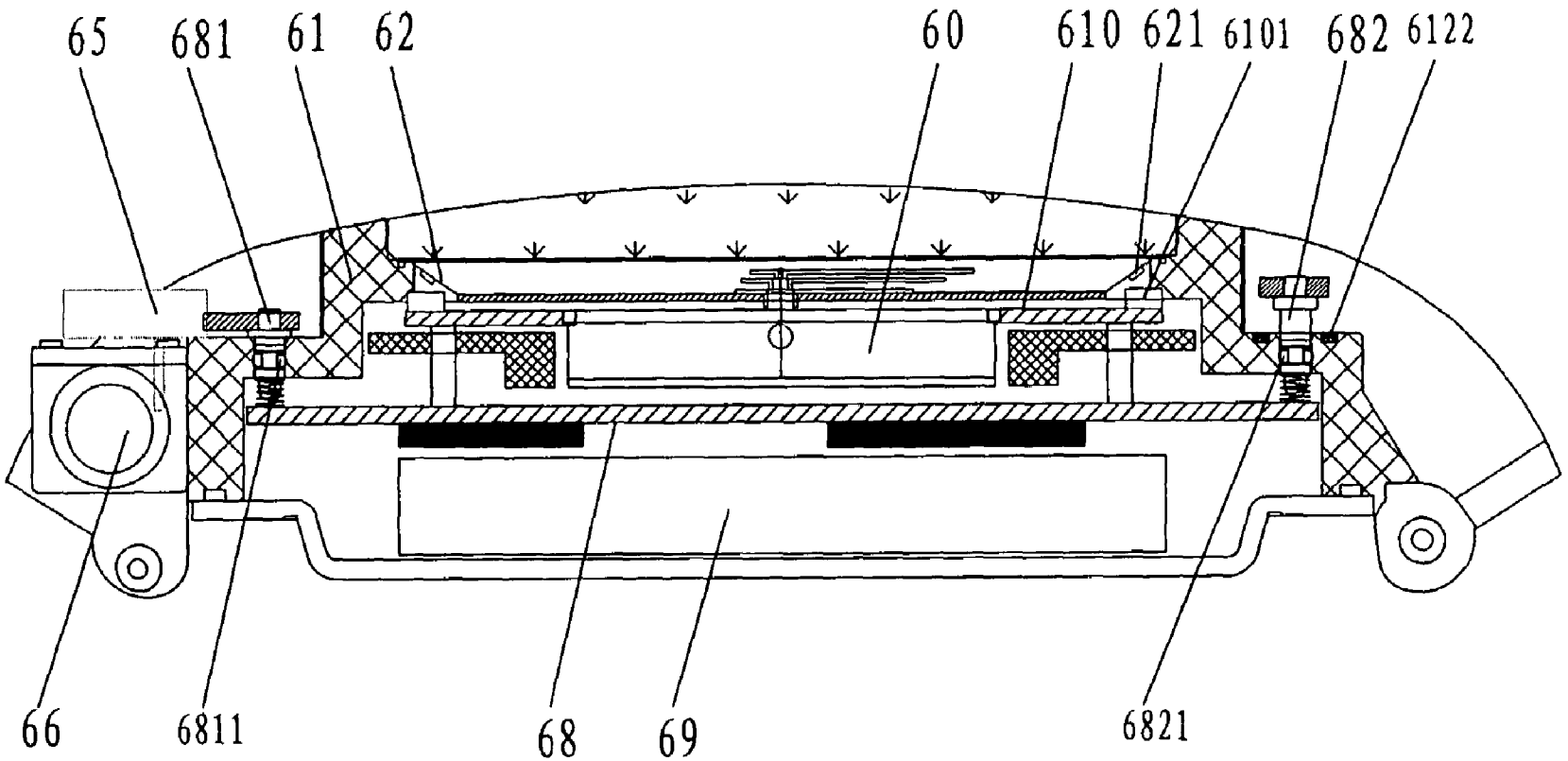
FIG. 20 is a cross-sectional view of the wristwatch according to embodiment VI of the invention.

As shown in FIG. 20 (combine FIG. 19 if necessary), the wristwatch of the invention comprises conventional watch components, such as a movement 60, some hands, a watchcase 61, a lens, a reflect light circle 62, a watch case back, and so on. The reflect light circle 62 under the lens has some fluorescence points 621, which is made of light-transparent material such as plastic. The reflect light circle 62 can be integrated injected with watchcase 61 or be injected single. A movement 60 fixing by the movement holder is installed in the wristwatch. A dial, some hands, a lens are placed on the movement 60 in turn. A LED control circuit board 610, on the periphery of the movement 60, containing some LED lamps 6101 placing under the fluorescence circle 621 of the reflect light circle 62 is under the dial (under the reflect light circle 62). The LED lamps 101 can show the working state of MP3 music playing or data transmitting respectively or conjunctly. A MP3 circuit board 68, connecting to the LED control circuit board 610, under the movement 60 comprises some components such as a flash memory, a MP3 CMOS chip. The flash memory not only can store the music files of the MP3 form, but also can store the electronic data files of other forms. The water proof button 681, as the circuit connecting point, installing at the point, under the concave step 611 of the watchcase 61, of the MP3 circuit 68 extend to the concave step 611 through the corresponding hole of the watchcase 61, and a gasket 6811 is placed between the water proof button 681 and the hole of the watchcase 61. The water proof button 682, as the circuit connecting point, installing at the point, under the concave step 612 of the watchcase 61, of the MP3 circuit 68 extend to the concave step 612 through the corresponding hole of the watchcase 61, and a gasket 6821 is placed between the water proof button 682 and the hole of the watchcase 61. Therefore, the wristwatch of the invention can resist water and the components such as MP3 circuit board 68 in it is protected strictly. Furthermore, a gasket 6122 around the water proof button 682 is placed on the concave step 612 of the watchcase 61. The microphone 65 and the earphone socket 66 on the concave step 611 of the watchcase 61 connect with the water proof button 681 which is the circuit connecting point. In order to connect the microphone 65, the earphone socket 66 and the USB connector assembly 67 more conveniently, two small pieces of the circuit board can be made. The small circuit boards connect to the water proof button 681 and the water proof button 682 respectively and provide the corresponding circuit connecting points for connecting the microphone 65, the earphone socket 66 and the USB connector assembly 67. A storage battery 69 for providing power when play MP3 music is installed between the MP3 circuit board 68 and the watch case back. The storage battery 69 can obtain power from computer or a corresponding charger via the USB connector assembly 67.

What is claimed is:

1. A wristwatch capable of storing and transmitting data comprises:

a timing indicating component;

a watch case; and a watch band for fixing the wristwatch to peoples's wrist, wherein, said wristwatch further comprises a circuit board assembly and a USB connector assembly, said circuit board assembly is installed inside the watch case and comprises a circuit board, on which are installed a Flash Memory and a CPU; said USB connector assembly comprises connection cable and a USB connector, said connection cable consists of data leads and power leads, which are used to connect the circuit board with the USB connector, the USB connector is located outside the watch case, said connection cable extends out of the watch case from an opening hole at the seam between the watch case and the watch band, a water proof means is provided around the opening hole; a housing means for housing and fixing the connection cable and the USB connector is provided on said watch band wherein, said watch band includes two sections 2A and 2B; said section 2A is undercutting according to the outline of the connection cable and the USB connector, so as to form a big through hole; said through hole is divided into two segments; a longer segment and a shorter segment, wherein the longer segment is made to house and lock the connection cable, the shorter segment is formed to lodge the USB connector, so that the outside part of the connection cable and the USB connector are beset in the section 2A of the watch band.

2. A wristwatch according to claim 1, wherein, a tongue like positioning piece is installed at the outside end of shorter segments of the section 2A of said watch band, so that said positioning piece extends into said USB connector and locks it in position.

3. A wristwatch according to claim 1, wherein, on section 2A of said watch band, a rib is installed for linking to two segments of the section 2A and securing the USB connector.

4. A wristwatch according to claim 1, wherein, said wristwatch further includes a loop, which is designed to fit the size of the USB connector, and can be slid along the watch band; several small pieces of projections are provided on both sides of said watch band at the shorter segment of the section 2A, and correspondingly several small concaves are provided on the inner surface of the loop, when the small projections are engaged with the small concaves, the loop can be positioned precisely so as to clamp the USB connector in the groove of the shorter segment of the Section 2A.

5. A wristwatch capable of storing and transmitting data comprises:

a timing indicating component including a time movement, hands, and a time dial, a watch case including a case back, a lens, a watch band of two sections for fixing the wristwatch to peoples's wrist, wherein, said wristwatch further comprises a microphone, an earphone socket, a USB connector assembly, a MP3 circuit board containing a flash memory and MP3 CMOS chip; said USB connector assembly comprising a USB connector, a connector socket, a USB cable and circuit connecting points;

said watch band having grooves for housing said USB connector, said connector socket, and said USB cable respectively, said watch band also having a colligated ring for ringing the USB connector;

a concave step is made in each of the two sides of said watch case near the two sections of the watch band; said microphone and said earphone socket are installed on the concave step 611; the end of said USB connector assembly containing said circuit connecting points is installed on the other concave step 612 of said watchcase;

one water proof button 681, for connecting said MP3 circuit board with said microphone and said earphone socket, is installed under said concave step 611 of said watchcase; another water proof button 682, for connecting said MP3 circuit board with said circuit connecting points of said USB connector assembly, is installed under said concave step 612 of said watchcase; said water proof button 681 and said water proof button 682 extend to said concave step 611 and said concave step 612 respectively through the corresponding hole of said watchcase; one gasket is placed between said water proof button 681 and said hole of said watchcase, another gasket is placed between said water proof button 682 and said hole of said watchcase;

said circuit connecting points of said USB connector assembly connects with said water proof button 682 of said concave step 612.

6. A wristwatch according to claim 5, wherein a reflect light circle around said hands is below said lens; a LED control circuit board containing LED lamp for showing working sate of said MP3 circuit board is under said reflect light circle.

7. A wristwatch according to claim 6, wherein some fluorescence points are made on the surface of the reflect light circle; said LED lamps are placed under said reflect light circle.

8. A wristwatch according to claim 5, wherein some buttons for controlling the working state of said MP3 circuit board are provided at the side of said watchcase.

9. A wristwatch according to claim 5, wherein said MP3 circuit board connects with said LED control circuit board.

10. A wristwatch according to claim 5, wherein said concave step 612 of said watchcase includes screw holes; a gasket around said water proof button 682 is placed on said concave step 612; said end containing circuit connecting points of said USB connector assembly can be made as a cover form matching the concave step 612 of the watchcase; said cover has two screw holes matching the screw holes of the concave step 612; said gasket is filled between said cover and said concave step 612.

11. A wristwatch according to claim 5, wherein said MP3circuit board is placed under said movement; said storage battery is placed between said MP3 circuit board and said watch case back.

12. A wristwatch according to claim 5, wherein said storage battery obtains power via the USB connector.

13. A wristwatch according to claim 5, wherein said wristwatch further includes two small circuit boards; one of said small circuit board around said water proof button 681 provides some circuit connecting points for connecting said microphone and said earphone socket; the other one around said water proof button 682 connects said circuit connecting points of said USB connector assembly.

* * * * *